US005145163A

United States Patent [19]

Cowan et al.

[11] Patent Number: 5,145,163

[45] Date of Patent: Sep. 8, 1992

[54] FILM SHEET LOAD MAGAZINE

[75] Inventors: Kevin P. Cowan, Allison Park; Stanley R. Lewandowski, Cheswick; David M. Reilly, Glenshaw; Arthur E. Uber, III, Pittsburgh, all of Pa.

[73] Assignee: Medrad, Inc., Pittsburgh, Pa.

[21] Appl. No.: 441,004

[22] Filed: Nov. 24, 1989

[51] Int. Cl.[5] ..... B65H 1/00

[52] U.S. Cl. ..... 271/161; 271/162; 271/167; 221/197; 221/287

[58] Field of Search ..... 271/161, 117, 118, 114, 271/116, 124, 125, 121, 145, 157, 162, 167, 171; 221/197, 198, 287, 6, 4, 213

[56] References Cited

U.S. PATENT DOCUMENTS

| | | | |
|---|---|---|---|
| 2,622,206 | 12/1952 | Passannante . | |
| 3,306,491 | 2/1967 | Eisner et al. | 221/197 X |
| 3,440,422 | 4/1969 | Ball et al. . | |
| 3,511,496 | 5/1970 | Zoglmann | 271/161 X |
| 3,553,453 | 1/1971 | Hogan . | |
| 3,567,931 | 3/1971 | Eelkema . | |
| 3,636,351 | 1/1972 | Lajus . | |
| 3,672,279 | 6/1972 | Hackenberg et al. . | |
| 3,710,106 | 1/1973 | Loucheur et al. . | |
| 3,724,352 | 4/1973 | Shimomura . | |
| 3,735,130 | 5/1973 | Bock et al. . | |
| 3,775,613 | 11/1973 | Hommerin . | |
| 3,807,726 | 4/1974 | Hope et al. | 271/207 |
| 3,827,070 | 7/1974 | Hoerenz et al. . | |
| 3,862,426 | 1/1975 | Thomas . | |
| 3,865,482 | 2/1975 | Bendall et al. . | |
| 3,891,850 | 6/1975 | Bridgeman . | |
| 3,908,984 | 11/1975 | Sohngen | 271/113 |
| 3,967,126 | 6/1976 | Otto, Jr. . | |
| 3,989,950 | 11/1976 | Hunt et al. . | |
| 3,998,118 | 12/1976 | Brophy et al. . | |
| 4,006,985 | 2/1977 | Hutner . | |
| 4,017,877 | 4/1977 | Powers . | |

(List continued on next page.)

FOREIGN PATENT DOCUMENTS

| | | | |
|---|---|---|---|
| 714921 | 12/1941 | Fed. Rep. of Germany . | |
| 1096802 | 12/1967 | Fed. Rep. of Germany . | |
| 1931645 | 12/1970 | Fed. Rep. of Germany . | |
| 2356252 | 4/1975 | Fed. Rep. of Germany . | |
| 2745994 | 4/1976 | Fed. Rep. of Germany . | |
| 2456448 | 8/1976 | Fed. Rep. of Germany . | |
| 57-67432 | 4/1982 | Japan | 271/21 |
| 61-254430 | 11/1986 | Japan | 271/161 |
| 300 | of 1906 | United Kingdom . | |
| 1189914 | 12/1967 | United Kingdom . | |
| 2170484 | 8/1986 | United Kingdom | 271/167 |

*Primary Examiner*—David H. Bollinger

*Attorney, Agent, or Firm*—Fleit, Jacobson, Cohn, Price, Holman & Stern

[57] ABSTRACT

A film sheet load magazine is adapted to hold a stack of superimposed films with at least central portions of the films in a curved configuration and leading ends of the films adjacent a film separator mechanism. The curvature of the films is such that they retain themselves in desired positions in the magazine independent of the orientation of the films with respect to gravity. When a top cover of the magazine is opened, floating primary feed rollers are raised by spring-biasing assemblies to facilitate loading of the films under the rollers, and when the top cover is subsequently closed, the rollers are moved into feeding engagement with an innermost film, and the films are held in position by leaf biasing springs. A cleaning mechanism removes contaminants from the primary feed rollers, which feed each film to secondary feed rollers driven at a faster speed than the primary feed rollers. A number-of-films-remaining mechanism, which may be of a mechanical or electrical type which is adjustable for films of different thicknesses, and which is automatically preset to the number of films in the magazine upon closing of the cover, is responsive to downward movement of the primary feed rollers as each innermost film is fed from the stack. A system also is provided for indicating if enough films remain in the magazine for a particular film processing operation and to inhibit operation of an associated device if insufficient films remain. The magazine may be self-driven or driven from an associated device.

75 Claims, 7 Drawing Sheets

U.S PATENT DOCUMENTS 4,025,187 5/1977 Taylor et al. ..... 271/10
4,199,687 4/1980 Brendl et al. .
4,204,668 5/1980 Yanagawa ..... 271/9
4,234,796 11/1980 Caugant et al. .
4,250,389 2/1981 Brendl et al. .
4,300,757 11/1981 Koiso et al. ..... 271/207
4,317,999 3/1982 Amtmann et al. .
4,342,510 8/1982 Guillaume .
4,346,297 8/1982 Suzuki et al. .
4,355,791 10/1982 Villa ..... 271/21
4,417,356 11/1983 Hoffman .
4,418,420 11/1983 Bauer et al. .
4,428,658 1/1984 Moore et al. .
4,447,053 5/1984 Wager et al. ..... 271/113
4,482,232 11/1984 Engelsmann .
4,521,097 6/1985 Kuehnle et al. .
4,566,785 1/1986 Takenouchi .
4,597,097 6/1986 Suzuki .
4,697,902 10/1987 Maehara et al. .
4,712,227 12/1987 Warden ..... 378/173
4,782,504 11/1988 Weber et al. .
4,893,322 1/1990 Hellmick et al. .
4,924,486 5/1990 Weber et al. .

FILM SHEET LOAD MAGAZINE

BACKGROUND OF THE INVENTION

1. Field of the Invention

This invention relates to a film sheet load magazine, and more particularly to a film sheet load magazine in which a stack of superimposed sheets are retained in the magazine with at least central portions of the sheets in a curved, essentially semi-circular configuration, to provide a compact and light-weight device of large sheet-holding capacity which is operable independent of orientation with respect to gravity, enables a stack of superimposed sheets to be loaded into the magazine en masse without interposing separators between the sheets, facilitates feeding of the sheets in succession one at a time to an associated mechanism, such as an x-ray film exposure device, in a reliable manner at high speed, provides an operator with an accurate indication of the number of films remaining in the magazine, and whether a sufficient number of sheets remain for a particular processing operation, and also inhibits operation of an associated device if there are insufficient sheets.

2. Description of the Prior Art

U.S Pat. No. 4,782,504 to O. K. Weber et al, which is assigned to the same assignee as the subject patent application, discloses a programmable X-ray film changer for use, for example, in making serial X-ray images of a patient in angiographic medical diagnostic studies. In that patent, a stack of films are stored horizontally disposed in a load magazine and fed from the magazine in succession one at a time into a film exposure device. For this purpose, separators are used to separate one film from another physically while they are being stored in the load magazine. In the feeding of one of the films, a drive mechanism, which includes an arm with a hook, is operated from the film exposure device and engages the top film in the stack at its trailing end, and, in essence, pushes the film into the film exposure device. Further, in load magazines of the type disclosed in that patent, and other known film changers, in order for an operator to know how many films remain in the magazine at any one time, the operator presets an indicator when the magazine is loaded.

Another type of presently known film sheet load magazine is one in which film sheets are stored in the magazine in an essentially curved configuration. For example, the British Patent No. 1,189,914 discloses a film load magazine in which the films are stored in the magazine in a curved condition in substantially semicircular grooves formed in opposite side walls of the magazine, with the grooves having curved central portions, straight horizontal lower end portions, and upwardly inclined opposite upper end portions. The films are fed out of the inside of the resultant curved stack by a spring-loaded friction member which is mounted on an intermittently driven rotatable shaft extending centrally and transversely across the magazine essentially diametrically with respect to the films.

Similarly, U.S. Pat. No. 4,355,798 to F. Villa discloses a film sheet load magazine in the form of a curved spout having a curved outer wall of a relatively high degree of curvature and a curved inner wall of reduced curvature. In loading the films into the magazine, a hinged and flanged end portion of the outer wall is pivoted upward and a stack of films is inserted into the magazine against the outer wall in superimposed relationship, after which the hinged wall portion is returned to a lower position so that a flange thereon abuts outer ends of the stack. During the insertion of the stack of film sheets into the magazine, the films slide upon one another to remove the tendency of the films to adhere together in subsequent feeding of the films. In a film feeding operation, the films are separated by a stripping device engaging an outer end portion of the lowermost film in the stack, whereupon this film, because of its elasticity and curvature in the magazine, moves forward to a mechanism for feeding the film into a film exposure station.

U.S. Pat. No. 4,447,053 to M. Wager et al discloses several embodiments of a film sheet load magazine in each of which the films are stored in a curved condition. To load the films into the magazine, the films are inserted one at a time into screw threads of a rotatable screw-threaded drive member and the drive member is rotated to move the inserted films downwardly in the magazine. To feed the films out of the magazine one at a time to a film exposure station, the drive member is rotated in a reverse direction to raise each film upward into a position into engagement with a feed mechanism which is external of the magazine.

U.S. Pat. No. 4,712,227 to H. Warden discloses a film sheet load magazine in which the films are stored in a curved condition with trailing ends of the films engaged against a retaining flange and leading ends of the films positioned in a separator mechanism. Thus, as in the case of the aforementioned Wager et al patent, the films must be loaded into the magazine with the leading ends of the films engaged between the separators, one at a time. In a film feeding operation, each film is fed from the magazine by an internal drive mechanism to an external drive mechanism which then feeds the film to a film exposure device.

Accordingly, a need exists for a film sheet load magazine which is of compact, light-weight construction, has a large sheet-holding capacity, is operable independent of orientation with respect to gravity, enables a stack of superimposed sheets to be loaded into the magazine simultaneously without interposing separators between the sheets, facilitates feeding of the sheets from the magazine in succession one at a time in a rapid and reliable manner, provides an accurate indication of the number of sheets remaining in the magazine at any one time and whether a sufficient number of sheets remain for a particular processing operation, and also inhibits operation of an associated device if there are insufficient sheets, and a purpose of this invention is to provide a film sheet load magazine having these characteristics.

SUMMARY OF THE INVENTION

In general, the subject invention relates to a sheet feeding magazine which comprises an enclosure adapted to receive a plurality of sheets which are in superimposed relationship, the enclosure including a wall having a sheet feed-out slot. A mechanism in the enclosure retains at least central portions of the superimposed sheets in a bowed, essentially semi-circular configuration within the enclosure, so that the sheets retain themselves in position independent of the orientation of the magazine with respect to gravity, with first end portions of the sheets adjacent the feed-out slot. Another mechanism may be provided in the enclosure for engaging and feeding an innermost one of the bowed sheets, each subsequent innermost sheet and a last sheet from the enclosure through the feed-out slot in succession, one at a time.

More specifically, the enclosure may include a cover member and a resilient biasing mechanism responsive to opening and closing of the cover member, for moving parts of the sheet feeding mechanism between sheet-loading and sheet-feeding positions. The cover member includes a stop mechanism (which also may function as a latch) for engaging opposite second end portions of the sheets, and the enclosure may include a leaf spring mechanism for biasing the first and second end portions of the sheets against a separator mechanism and the stop mechanism, respectively.

The sheet feeding mechanism may comprise feed rollers which engage only edge portions of the sheets and which have peripheries designed to enhance the drive force between the surface of each sheet and the rollers. A cleaning mechanism, which may be rotatable brushes, may be provided for cleaning contaminants from the feed rollers, and the feed rollers also may include transverse grooves to facilitate the cleaning operation. The feed rollers and the cleaning brushes may be supported on respective floating shafts, which are mounted for pivotable movement about a drive shaft, from which the floating shafts are driven. The drive shaft may be driven from an associated device upon which the magazine is mounted, by operation of a gear rack mechanism within the magazine. In addition, a mechanism may be provided for indicating the number of sheets remaining in the enclosure as the sheets are fed from the enclosure by the sheet feeding mechanism, and whether a sufficient number of sheets remain for a particular processing operation, and also inhibiting operation of an associated device if there are insufficient sheets.

DETAILED DESCRIPTION

Figure 1:
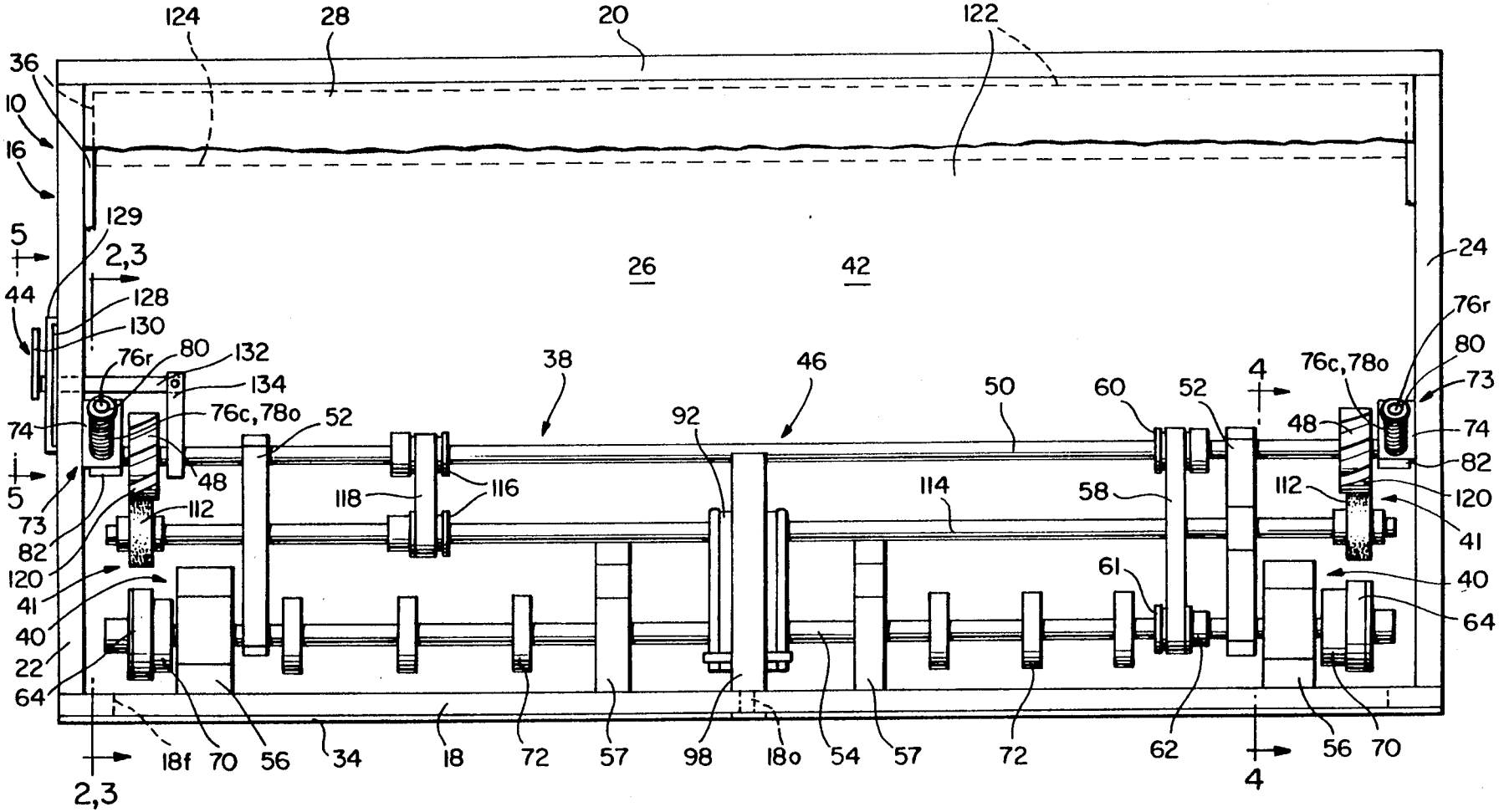
FIG. 1 is a plan view of a film sheet load magazine in accordance with the invention, with a top cover partially broken away.
Figure 2:
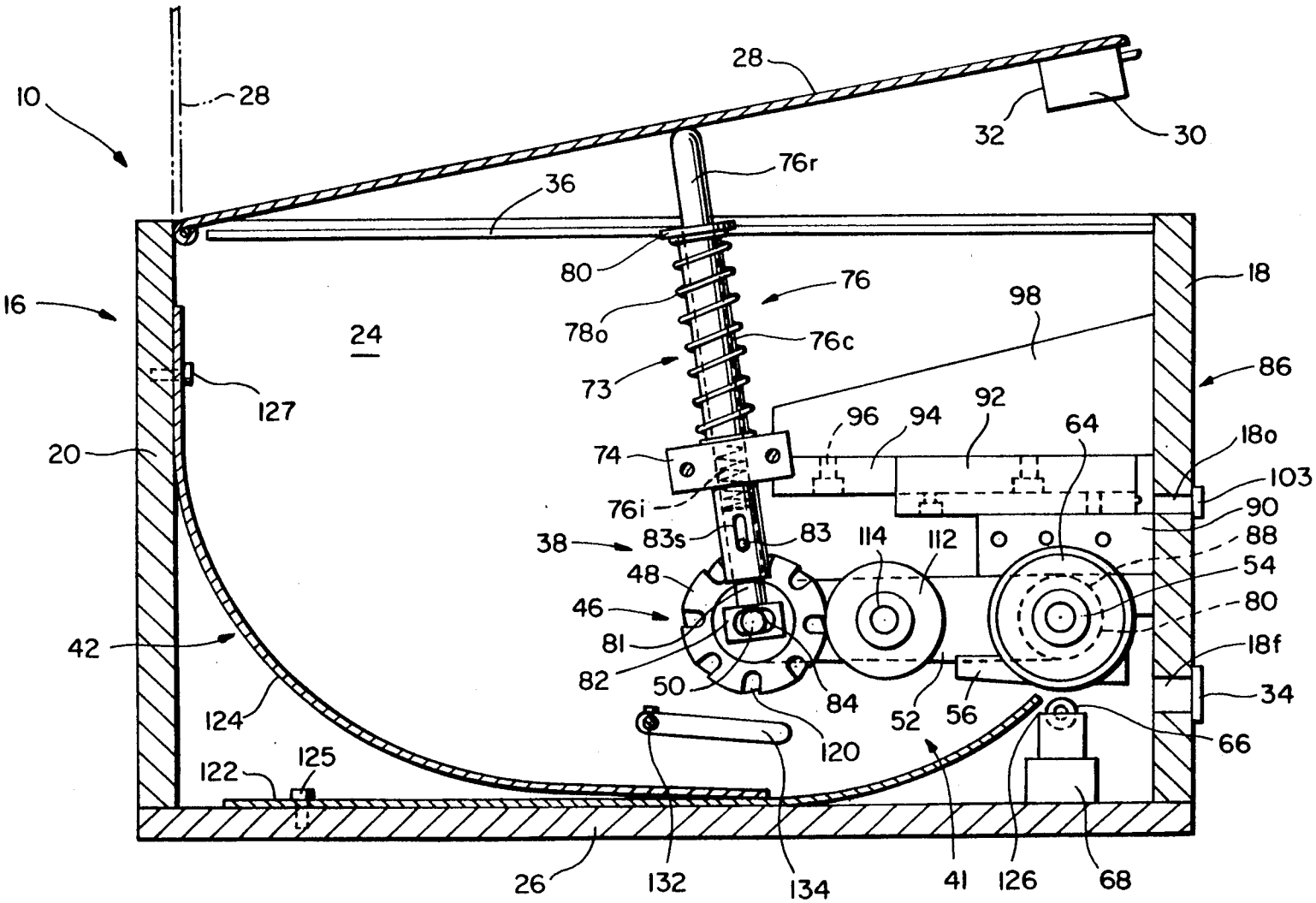
FIG. 2 is a cross-sectional view of the film sheet load magazine taken along the line 2—2 in FIG. 1, with the top cover open and the magazine in an unloaded condition.
Figure 3:
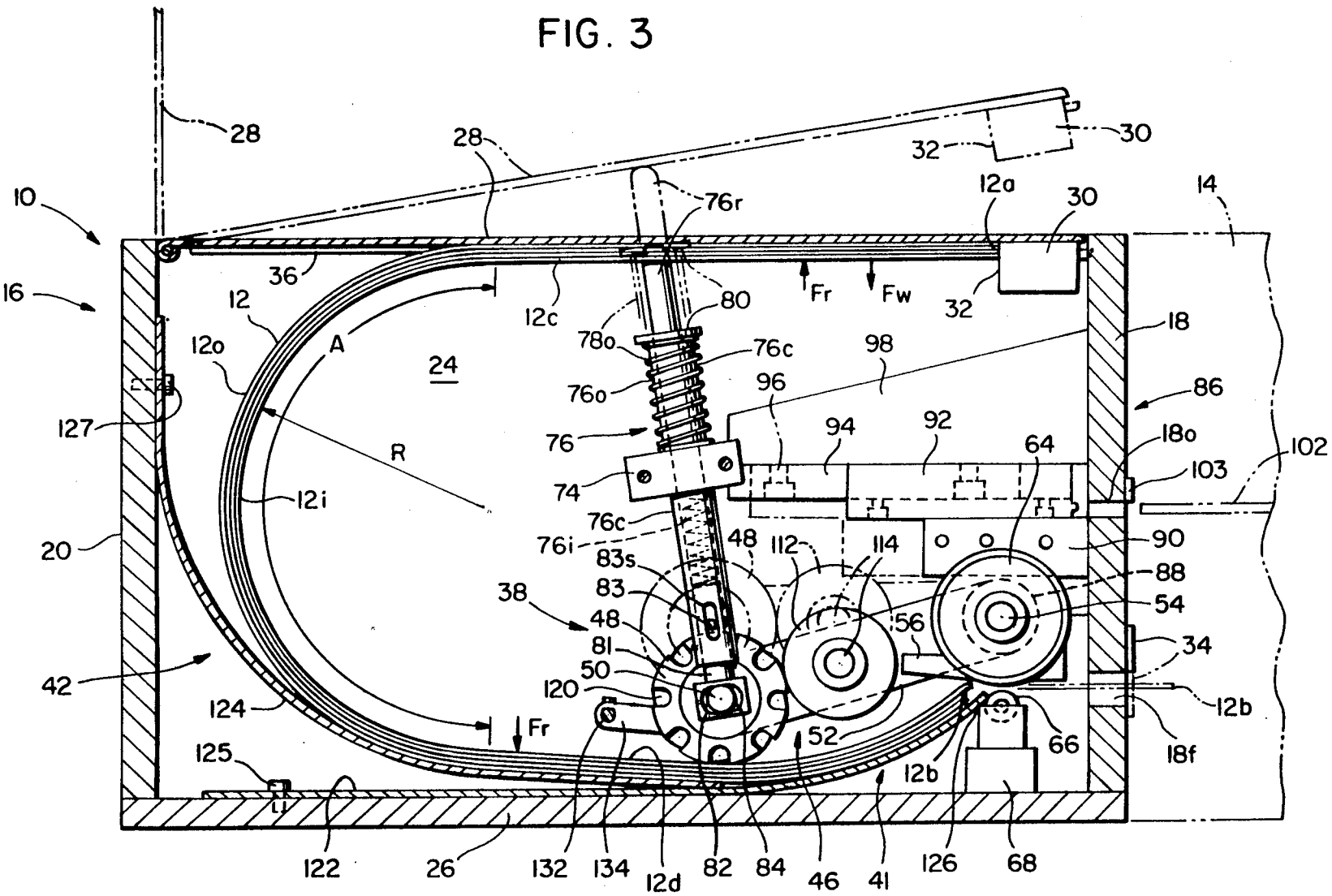
FIG. 3 is a cross-sectional view of the film sheet load magazine, taken along the same line as FIG. 2, illustrating a stack of superimposed film sheets loaded into the magazine and with the top cover closed.
Figure 4:
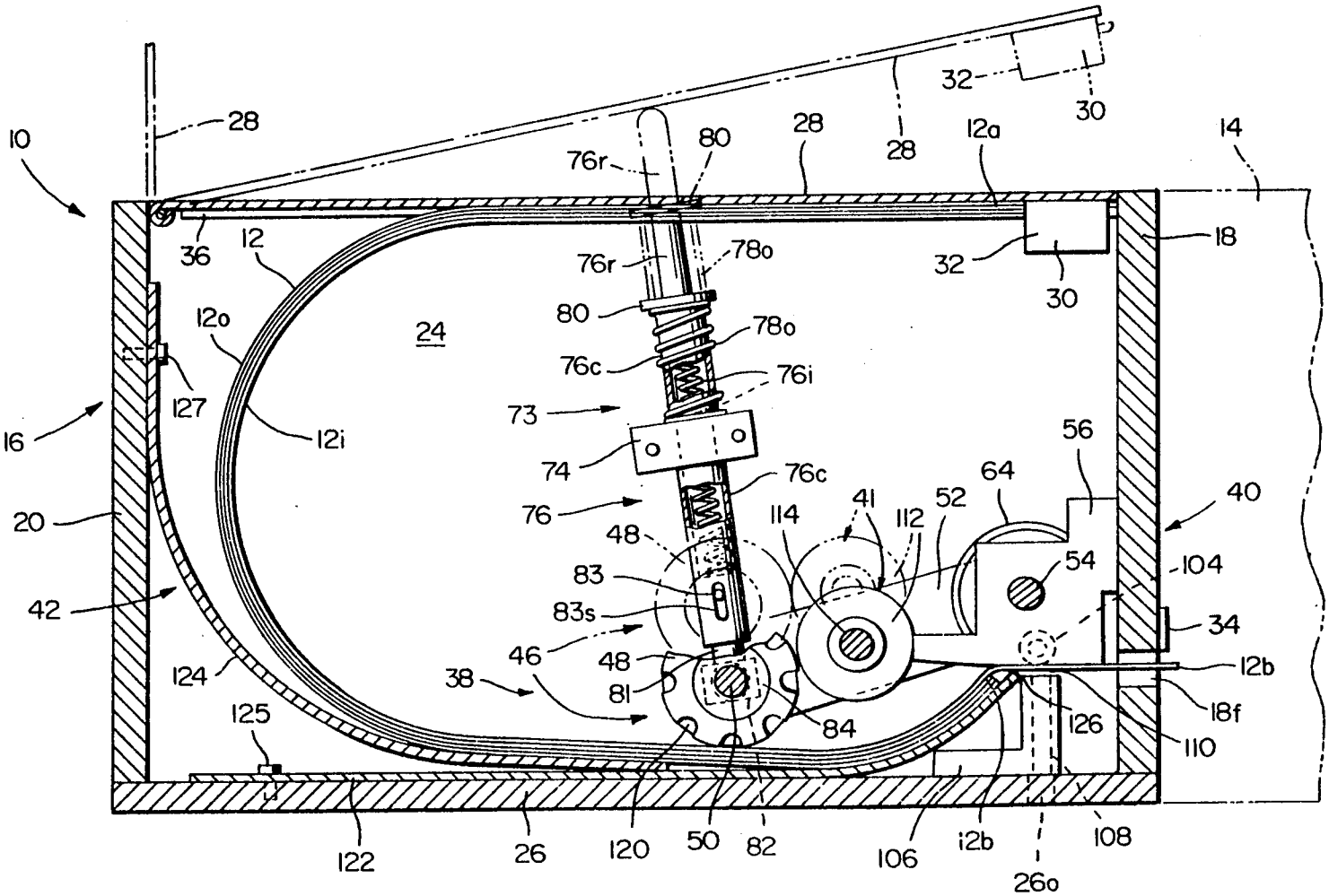
FIG. 4 is another cross-sectional view of the film sheet load magazine, similar to FIG. 3 and taken along the line 4—4 in FIG. 1, after the stack of film sheets has been loaded into the magazine.

Referring to FIGS. 1-4, the subject invention relates to a curved stack film sheet load magazine 10 for storing normally straight-line planar film sheets 12 (FIGS. 3 and 4), such as X-ray films, and feeding the films in succession to an associated device 14 (shown in phantom in FIGS. 3 and 4), such as a film exposure device utilized in angiographic analysis of a patient. The magazine 10 is in the form of a box-shaped housing or enclosure 16 having a front wall 18, a rear wall 20, opposite side walls 22 and 24, a bottom wall 26 and a hinged top cover 28. The top cover 28 includes a suitable latch mechanism 30 (FIGS. 2-4) which in the disclosed embodiment of the invention also defines a stop 32 for upper trailing ends 12*a* of the films 12, as shown in FIGS. 3 and 4. The front wall 18 of the housing 16 includes a film feed-out slot 18*f* through which the films 12 are fed from the magazine 10 into the film exposure device 14. A suitable light-blocking shutter 34 for the film feed-out slot 18*f*, is slidably mounted for vertical movement on the front wall 18 of the housing 16, and is movable to an open position when the magazine 10 is mounted on the film exposure device 14, in a known manner, not shown. The magazine 10 also includes a light-blocking seal 36 of a suitable type around its upper periphery, which cooperates with the top cover 28 when the cover is closed, so that the magazine is of light-tight construction.

Figure 5:
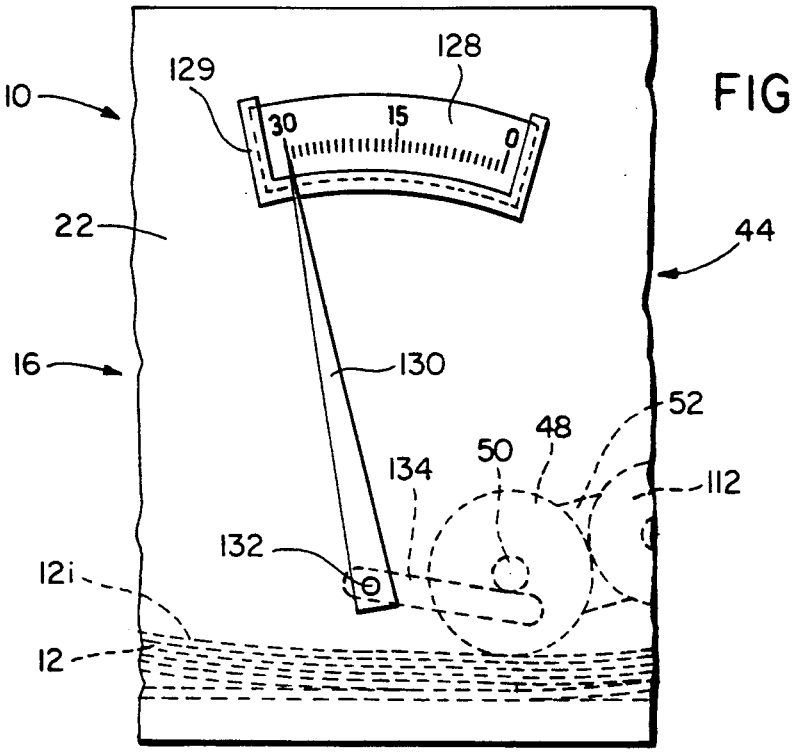
FIG. 5 is a side elevational view of the film sheet load magazine, as seen along the line 5—5 in FIG. 1, illustrating a number-of-sheets-remaining mechanism.

The magazine 10 further comprises a film feeding mechanism 38 for feeding the films 12 from the magazine in succession one at a time through the feed-out slot 18*f*, a film separator mechanism 40 (FIGS. 1 and 4) for ensuring that only one film feeds at a time when the films are being fed at high speed, a film feed roller cleaning mechanism 41, and a curved film stack-biasing mechanism 42, mounted within the magazine. Further, a number-of-films-remaining mechanism 44 is mounted in part within the magazine 10, as shown in FIG. 1, and mounted in part externally of the magazine, as shown in FIGS. 1 and 5.

The film feeding mechanism 38 includes a floating assembly 46 which comprises pair of primary feed rollers 48 fixedly mounted at opposite ends of a horizontally extending rotatable floating support shaft 50. The support shaft 50 is journaled for rotation in outer ends of a pair of pivotable lever members 52. Inner ends of the lever members 52 are pivoted on a rotatable drive shaft 54 journaled in a pair of end support blocks 56 and a pair of inner support blocks 57 secured to the magazine front wall 18. The primary feed roller support shaft 50 is driven from the drive shaft 54 by a belt 58 extending around pulleys 60 and 61 mounted on respective ones of the shafts, with the pulley on the drive shaft being driven by a one-way clutch 62.

The film feeding mechanism 38 further includes a pair of secondary feed rollers 64 which, after a leading edge of one of the films 12 has been advanced to the secondary feed rollers by the primary feed rollers 48, causes further feeding of the film through the feed-out slot 18*f* to a feed mechanism (not shown) in the film exposure device 14. For this purpose, the secondary feed rollers 64 are rotatably mounted on the drive shaft 54 in opposed relationship to respective pinch rollers 66 (FIGS. 2 and 3) rotatably mounted in upper end portions of support blocks 68 having bottoms fixedly mounted on the housing bottom wall 26. The secondary feed rollers 64, like the primary feed rollers 48, are driven by the drive shaft 54 through respective one-way clutches 70, as is best shown in FIG. 1. As is also shown in FIG. 1, the drive shaft 54 includes a plurality of longitudinally spaced idler rollers 72 rotatably supported thereon, under which each of the films 12 feeds during a film feeding operation. Preferably, the secondary feed rollers 64 have a greater film drive speed than the primary feed rollers 48, such as by making the primary feed roller pulleys 60 of larger diameter than the pulleys 61 on the drive shaft 54, so that the primary feed rollers initially start the feeding of one of the films 12 at a relatively slow speed without significant slippage, after which the secondary feed rollers accelerate the film at a relatively high speed to the film exposure device 14.

Referring to FIG. 2, when the top cover 28 is opened, the floating assembly 46 comprising the primary feed rollers 48 is driven into an upper position shown in this figure (also shown in broken lines in FIGS. 3 and 4) by spring-biasing mechanisms 73, which are located at opposite sides of the housing 16, to permit loading of the films 14 into the housing. (The cover 28 may be moved to a further open position as illustrated in phantom in FIG. 2, for this purpose.) Each of the spring-biasing mechanisms 73 includes a support block 74 fixedly mounted on the adjacent housing side wall 22 or 24. A substantially vertically extending actuating assembly 76, which includes an upper rod portion 76*r*, and a lower cylindrical portion 76*c* slidably mounted in the support block 74, is biased upward by an outer coil spring 78*o* disposed between the support block and an annular collar 80 on the cylindrical portion. An upper end of the actuating rod portion 76*r* is engageable with the top cover 28, and a lower end of an actuating rod 81, which is slidably disposed in a lower end of the cylindrical portion 76*c*, carries a coupling member 82 connected to the primary feed roller support shaft 50 by an elongated lost-motion slot 84 through which the shaft extends. The lower rod 81 is biased downward by an inner coil spring 78*i* of reduced compressive strength compared to the outer spring 78*o* and is disposed between the coupling member and an upper internal end of the cylindrical portion 76*c* adjacent the collar 80. The lower rod 81 is retained in the cylindrical portion 76*c* by a pin 83 disposed in lost motion slots 83*s* in opposite sides of the cylindrical portion.

Thus, when the top cover 28 is opened, the outer coil springs 78*o* drive the actuating assemblies 76 upward, to move the floating assembly 46 comprising the primary feed rollers 48 upward into a position for loading of the films 12. When the top cover 28 then is closed after the film-loading operation is completed, the cover engages and drives the actuating assemblies 76 downward against the action of the outer coil springs 76*o* and the inner coil springs 78*i*, to move the floating assembly 46 downward and so that the inner coil springs bias the primary feed rollers 48 into pressure frictional engagement with opposite edge portions of an innermost film 12*i* for feeding of the film.

As is best shown in FIG. 3, the drive shaft 54 is driven by a gear rack mechanism 86 which includes a pinion gear 88 fixedly mounted on the drive shaft and a gear rack 90 fixedly supported on the underside of a horizontally movable slide assembly 92. The slide assembly 92 is of a channel-shaped configuration and is supported for horizontal sliding movement on a guide member 94 by a tongue-and-groove connection in a known manner. The guide member 94 is secured by screws 96 to the underside of a support block 98 having a right-hand end, as viewed in FIG. 3, fixedly secured to the front wall 18 of the housing 16. The gear rack 90 and slide assembly 92 are biased toward the front wall 18 of the housing 16 into an initial start position by internal biasing springs (not shown) in the slide assembly, and are driven in a film feeding operation to the left, as viewed in FIG. 3, by an actuating rod 102 in the film exposure device 14 receivable in an opening 18*o* in the magazine front wall 18, with the opening being provided with a suitable retractable shutter 103.

Referring to FIG. 4, the film separator mechanism 40 comprises a small separator idler roller 104 rotatably mounted in a lower portion of each of the support blocks 56 so as to extend slightly below the bottom of the support block. A separator block 106 is mounted on the bottom wall 26 of the housing 16 beneath each separator roller 104 and a screw-threaded gaging pin 108 is mounted in each of the separator blocks so that an upper end of the pin projects slightly above the separator block. Thus, by adjusting the height of each of the gaging pins 108 in the separator blocks 106 through an access opening 26*o* in the magazine bottom wall 26, so that gaps 110 between the separator rollers 104 and the upper ends of the gaging pins correspond to the thickness of each of the films 12, the separator mechanism 40 will permit only one of the films to feed therethrough at a time.

During the feeding of the films 12, contaminants which tend to buildup on the primary feed rollers 48, such as emulsion residue, and which tend to decrease their coefficient of friction, are removed from the peripheries of the feed rollers by rotatable cleaning brushes 112 of the roller cleaning mechanism 41. The cleaning brushes 112 are fixedly mounted on a second floating support shaft 114 of the floating assembly 46, and this shaft, like the primary feed roller support shaft 50, is journaled in the pivoted levers 52. The second floating shaft 114, as is best shown in FIG. 1, is driven from the primary feed roller support shaft 50 by pulleys 116 on respective ones of the shafts, and a drive belt 118. Thus, as the primary feed rollers 50 are driven from the drive shaft 54 in a film feeding operation, the cleaning brushes 112 also are positively driven relative to the peripheries of the primary feed rollers to clean the contaminants therefrom. In this regard, transversely extending grooves 120 in the peripheries of the primary feed rollers 50 also aid in the cleaning of the contaminants from their peripheral surfaces.

Referring to FIGS. 3 and 4, during the feeding of the films 12 from the magazine 10, the upper trailing end portions 12*a* of the films are held engaged with the stop 32 on the top cover 28 and lower leading end portions 12*b* of the films are supported in an upwardly curved configuration adjacent the separator mechanism 40 (FIG. 4), to facilitate film feeding, by the film-biasing mechanism 42. For this purpose, the film-biasing mechanism 42 includes a set of first and second precurved leaf springs 122 and 124. The first leaf spring 122 is positioned over a substantial portion of its length upon the top surface of the housing bottom wall 26 and is secured to the bottom wall at its left-hand end by screws 125 (only one shown), as viewed in FIGS. 2–4. The right-hand end of the leaf spring 122, as viewed in these figures, engages the underside of the drive shaft support blocks 56 when the magazine 10 is empty, as shown in FIG. 2, and rests upon upper end portions of the pinch roller support blocks 68 (FIG. 3) and the separator blocks 106 (FIG. 4) When the magazine is loaded, as indicated at the reference number 126. Thus, as the films 12 feed from the magazine the leaf spring 122 tends to raise the leading ends 12*b* of the films to elevate the films so that the next innermost film is in a proper feeding position. The second leaf spring 124 has an upper end portion extending vertically and secured to the inner surface of the housing rear wall 20 by screws 127 (only one shown), with the spring curving downward and having an opposite end portion resting upon the horizontally extending portion of the first leaf spring 122. Thus, the leaf springs 122 and 124 cooperate to maintain the films 12 in a desired position within the housing 16 as above-described.

Referring to FIG. 3, a radius of curvature R to which the normally straight-line planar films 12 are bent in the magazine 10, and the length of an arc A along which the films are bent into a curved or bowed configuration before merging with essentially tangential and planar upper and lower film portions 12*c* and 12*d*, respectively, varies depending upon the stiffness of the films. More specifically, the values of R and A are chosen so that outward restoring forces Fr exerted by the upper film portions 12*a* and 12*c* against the top cover 28, and by the film lower portions 12*b* and 12*d* against the leaf springs 122 and 124, as a result of the films tending to return to their original straight-line planar configuration, are such that the restoring forces are greater than the weight Fw of the films (illustrated in FIG. 3 for the film upper portions 12*a* and 12*c*). Thus, the films 12 retain themselves in desired positions (as illustrated in FIG. 3) in the magazine 10 without the upper or lower film portions 12*a*–12*d* drooping or sagging, regardless of the orientation of the magazine (e.g., right side up or upside down) with respect to gravity. At the same time, since the film restoring forces Fr of the films 12 from the innermost film 12*i* to an outermost film 12*o* are cumulative, the frictional resistance between the innermost film and the next adjacent film is less than the frictional resistance between the other films. Thus, the combined effect of properly choosing R and A values is that the innermost film 12*i* more readily separates from its adjacent film and is easier to feed than the other films, whereby the initial and each subsequent innermost film will feed while the other films remain in position. By way of illustration, in the embodiment of the invention shown in FIGS. 1–5, wherein the film sheets 12 are x-ray films used in angiographic studies, radius R may be in a range on the order of 2–3 inches, and the length of the arc A may be on the order of 180 degrees. An arc length A greater than 180 degrees also may be utilized to provide a more compact load magazine 10, if so desired. Further, the essentially tangential film portions 12*c* and 12*d* may be essentially planar as shown in FIG. 3, or slightly curved, as desired.

As is best shown in FIG. 5, the number-of-films-remaining indicating mechanism 44 may include a scale 128 removably received in a holder 129 fixed to the side wall 22 of the housing 16, with the scale having number markings graduated in accordance with the thickness of the films 12 being processed. Associated with the scale 128 is a film-remaining indicator in the form of a pointer member 130 having an upper end movable relative to the scale. A lower end of the pointer 130 is fixedly mounted on an outer end of a rotatable shaft 132 journaled in and extending through the housing side wall 22. An inner end of the shaft 132 has one end of an operating lever member 134 rigidly fixed thereto. An opposite end of the operating lever 134 is disposed beneath the primary feed roller drive shaft 50 so that the lever is incrementally responsive to downward movement of the shaft during each film feeding operation. As a result, the lever 134 causes a corresponding rotational movement of the shaft 132 and the pointer 130 to give an operator an indication on the scale 128 of the number-of-films-remaining in the magazine 10. Where films 12 of a different thickness are to be processed, the scale 128 may be replaced in the holder 129 with a different suitably graduated scale; thus, the removable scales provide an adjustment for the processing of films of different thicknesses. Other adjustable type mechanisms, such as a longitudinally adjustable lever having a roller on an outer end engageable beneath the support shaft 50 at variable locations, also may be utilized.

In operation of the sheet feeding or load magazine 10, the magazine is loaded in a dark room by first releasing the latch 30 and opening the top cover 28. As is shown in FIG. 2, this permits the biasing springs 78*o* of the spring-biasing assemblies 76 to raise the floating assembly 46, including the primary feed rollers 48, upward relative to the bottom wall 26 of the magazine 10.

A stack of the film sheets 12 then is inserted in the back of the housing 16 and slid along the film biasing leaf springs 122 and 124 and under the primary feed rollers 48 until the leading ends 12*b* of the films 12 are stopped by the separator assembly 40. The trailing ends 12*a* of the films 12 then are placed against the stop 32 on the top cover 28 and the top cover is closed as shown in FIGS. 3 and 4. Closing of the top cover 28 causes at least the central portions of the films 12 to be curved into a bowed configuration and, since the films in the stack then extend along arcs of progressively increasing radii from the innermost film 12*i* to the outermost film, the leading ends of the films become "feathered" in step-like fashion so that each innermost film projects slightly forward of the adjacent outermost film to facilitate feeding of the films by the primary feed rollers 48. The closing of the top cover 28 also causes the spring-biasing assemblies 76 to urge the floating assembly 46 downward so that the primary feed rollers 48 come into engagement with the upper surface edge portions of the innermost film 12*i* in readiness for a film feeding operation. At the same time, the number-of-films-remaining mechanism 44 is operated by the primary feed roller drive shaft 50 so that the pointer 130 (FIG. 5) automatically indicates on the scale 128 the number of films 12 which are in the magazine 10, thus eliminating the possibility of operator error in presetting of an indicating mechanism, as is the case with prior known devices. The load magazine 10 then is mounted on the film exposure device 14 for a film exposure operation.

At the beginning of a film exposure operation, the actuating rod 102 of the film exposure device 14 is moved to the left, as viewed in FIG. 3, through the opening 18*o* in the front wall 18 of the magazine 10 at a predetermined time in the operation of the film exposure device, to drive the gear rack 90 and the spring-biased slide assembly 92 to the left in this figure. As a result of this movement, the gear rack 90 rotates the pinion gear 88 which rotates the drive shaft 54 counter clockwise, as shown in FIG. 3. Rotation of the drive shaft 54 causes rotation of the primary feed roller support shaft 50 and the primary feed rollers 48 through the one-way clutch 62, the pulleys 60, 61 and the belt 58. Simultaneously, the secondary feed rollers 64 on the drive shaft 54 are rotated through the one-way clutches 70, and the cleaning brush support shaft 114 and the cleaning brushes 112 are rotated from the primary feed roller support shaft 50 through the pulleys 116 and the belt 118.

The rotation of the primary feed rollers 48, through frictional engagement with the top surface edge portions of the innermost film 12*i*, then causes this film to feed through the gap 110 between the separator rollers 104 and pins 108, as illustrated in FIG. 4, to the secondary feed rollers 64 and the pinch rollers 66, as illustrated in FIG. 3, from which the film is driven at an accelerated rate through the feed-out slot 18*f* to the abovementioned feed mechanism (not shown) in the film exposure device 14. At the same time, the separator rollers 104 and pins 108 prevent the remaining films 12 from feeding with the innermost film 12*i*. Upon retraction of the actuating rod 102 , the gear rack 90 and the spring-biased slide assembly 92 are moved back to the right in FIG. 3 to their initial start position by the springs (not shown) in the slide assembly. During this return movement, since the primary feed rollers 48 and the secondary feed rollers 64 are connected to the drive shaft 54 through the respective one-way clutches 62 and 70, the primary and secondary drive rollers are free to roll with the film 12 as it is pulled from the magazine by the drive mechanism in the film exposure device 12.

In feeding of the innermost film 12*i*, as the trailing end 12*a* of the innermost film 12*i* clears the primary feed rollers 48, the primary feed rollers are biased downward by the spring-biasing assemblies 76 an increment corresponding to one film thickness, into engagement with the upper surface of the next film 12 in preparation for the next film feeding operation. This downward incremental movement also causes the primary feed roller drive shaft 50 to pivot the levers 134 of the number-of-films-remaining mechanism 44 a corresponding increment, to move the pointer 130 on the scale 128 one film increment, to indicate to the operator the number of films (i.e., one less) still remaining in the magazine 10.

Figure 6:
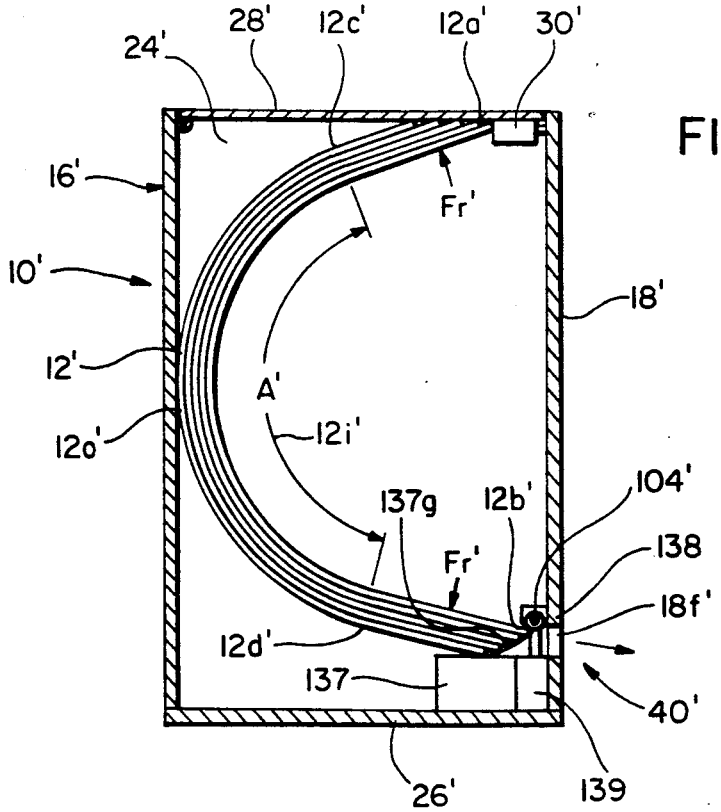
FIGS. 6 to 10 are schematic views illustrating alternate embodiments of the invention.

Referring to FIG. 6, this figure illustrates schematically an arrangement of film sheets 12' which may be used in a magazine 10' where the films have a greater degree of stiffness than the films 12 in the embodiment of the invention shown in FIGS. 1–5, with like parts being identified by the same reference numbers. In the embodiment of the invention shown in FIG. 6, central portions of the films 12' are bent from a straight-line planar configuration into a curved configuration with opposite end portions 12*c'* and 12*d'* of the films in an essentially planar tangential configuration. The degree of bending of the films 12' from the planar configuration, along an arc A' extending between transition points at which the curved portions of the films merge into the tangential planar portions 12*c'* and 12*d'* of the films, is less than 180 degrees. Upper ends 12*a'* of the films 12' may bear against a top cover 28' and a latch-stop member 30', 32', and lower ends 12*b'* of the films may bear against transversely spaced support block assemblies 137 (only one shown) each having an upwardly extending curved guide surface 137*g*, with the lower end of an innermost film 12*i* engaged against a vertically retractable gate 138 adjacent separator idler roller 104'. With the films 12' arranged as shown in FIG. 6, reverse bending forces Fr' exerted by the films upon one another, the top cover 28' and the support block assembly 137 in an attempt to return to the straight-line planar configuration, are such that the films tend to separate, primarily at their central portions as illustrated in this figure, such that the innermost film 12*i'* tends to be ejected from the next adjacent film. As a result, the films 12' tend to be self-feeding and, under certain circumstances, a positive drive mechanism for the films can be eliminated; rather, feeding of the films can be controlled by providing a film separator mechanism 40', including the gate 138, which normally blocks feeding of the films, and which is movable downward to an unblocking position by a solenoid 139 at a preselected time an increment sufficient to permit only the innermost film 12*i* to self-feed from the magazine 10'. As the trailing end 12*a'* of the innermost film 12*i'* clears the gate 138, the solenoid 139 returns the gate to its original position and the next adjacent film 12' then will feed up the inclined guide surface 137*g* against the gate, which then will again be subsequently moved downward on the next film feeding cycle, to permit feeding of this film, with this sequence of operations being repeated until the magazine 10' is empty.

Figure 7A:
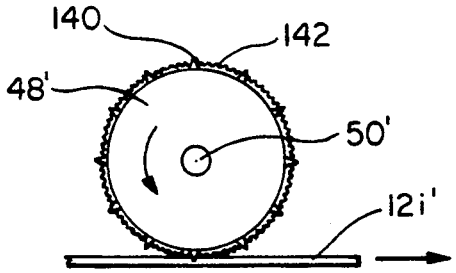

FIG. 7A discloses an alternate embodiment of a film primary feed roller 48' in which the feed roller is provided with a plurality of small, peripherally-spaced, radially projecting pins 140 for penetrating the surface of an innermost film 12*i'*, to provide a positive drive connection between the feed roller and the film. In the alternative, or as a supplement to the pins 140, the periphery of the feed roller 48' may have a roughened surface 142 to enhance the frictional resistance between the roller and the film 12*i'*, to enhance the feeding ability of the roller. For example, the roughened surface may be provided by etching, knurling, the formation of small teeth on the roller periphery, or providing the periphery of the roller with a suitable coating of grit-like material.

Figure 7B:
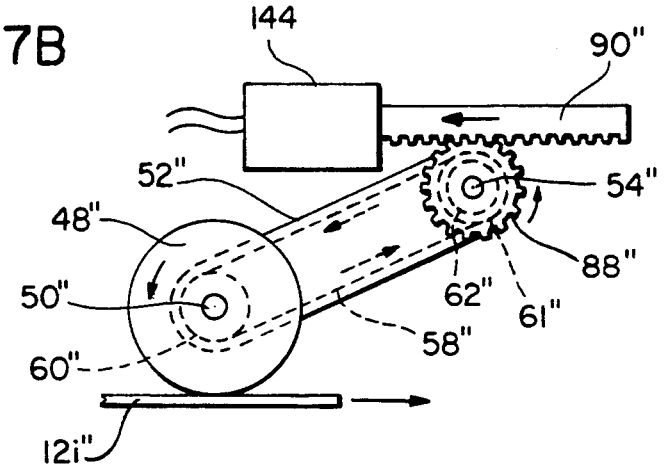

FIG. 7B discloses a drive arrangement which may be used where it is desired that the sheet feeding load magazine 10 of FIGS. 1–5 include its own drive mechanism so as to have the capability of being driven independently of the film exposure device 14. In this embodiment, a gear rack 90'' is energized by a small solenoid 144 to drive a gear 88'' on a drive shaft 54''. The drive shaft 54'', through a one-way clutch 62'', pulleys 60'', 61'' and a belt 58'', then drives primary feed rollers 48'' on a floating shaft 50'' supported in pivoted levers 52'', to feed a film 12*i''*. In the alternative, this arrangement for driving the shaft 54'' may be replaced with a drive comprising a small electric motor.

Figure 7C:
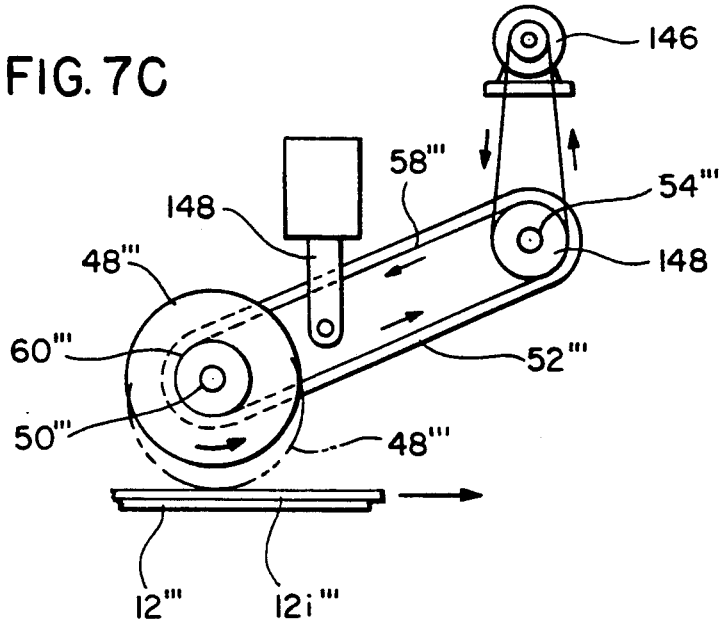

FIG. 7C discloses an embodiment of the invention in which primary feed rollers 48''' may be continuously driven and moved into engagement with an innermost film 12*i'''* at a preselected time for a film feeding operation. Thus, in this embodiment, a small electric motor 146 may drive a pulley 148 fixed to a drive shaft 54''', which in turn drives a floating support shaft 50'''which is mounted in pivoted levers 52''', and which drives the primary feed rollers 48''' by pulleys 60''', 61''' and a belt 58'''. Movement of the primary feed rollers 48''' into engagement with the film 12*i'''* may be accomplished by solenoid-operated rods 148 pivoted to the levers 52''' and internally spring-loaded in a suitable manner, not shown. This arrangement is advantageous in that it facilitates separation of the innermost film 12*i'''* and each additional film 12''' from the next adjacent film because the instantaneous acceleration of the film being fed is so great that the frictional force between the adjacent films is quickly changed from static friction to dynamic friction, which is less that static friction; thus, less force is required to accelerate and break each of the films away from the next adjacent film, in each film feeding operation. The arrangement in FIG. 7C also is advantageous in that it eliminates repetitive acceleration and deceleration of the film-feeding components. Another advantage is that it enables the primary feed rollers 48''' to be lifted off one of the films 12''' being fed before the rollers can engage the next adjacent film and move the latter film prematurely.

Figure 8:
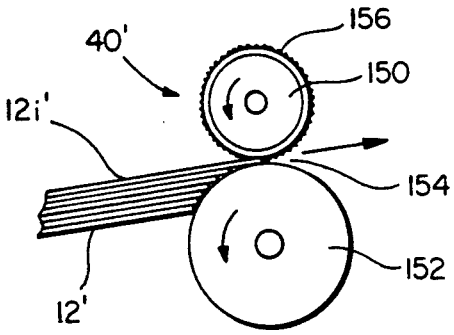

Referring to FIG. 8, an alternate embodiment of a film separator mechanism 40' is shown in which an upper separator roller 150 is power driven in one direction, such as counter clockwise as viewed in FIG. 8, in a suitable manner, such as by a small motor, not shown. A lower separator roller 152, spaced from the separator roller 150 to define a gap 154 between the rollers equal to the thickness of films 12', is driven in a similar manner. In operation, the upper separator roller 150 engages the top surface of an innermost film 12*i*' to feed the film through the gap 154 between the upper roller and the lower roller 152, while the lower roller applies a film feeding-retarding force to the remaining films 12'. For this purpose, since the separator rollers 150 and 152 are rotating in opposite directions adjacent the gap 154 therebetween, the upper separator roller applies a greater driving force to the innermost film 12*i*' than does the lower separator roller, as for example, as a result of providing the periphery of the upper separator roller with a roughened driving surface 156, while providing the periphery of the lower separator roller with a smooth surface which slides with respect to the bottom surface of the innermost film and also does not damage the leading edges of the remaining films 12'.

Figure 9A:
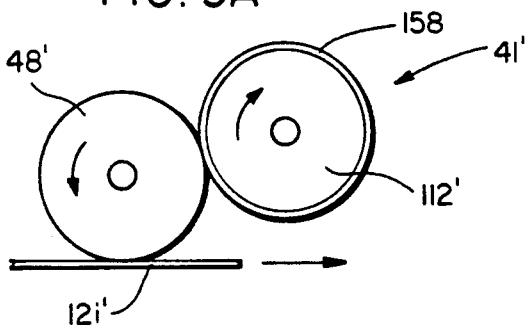
Figure 9B:
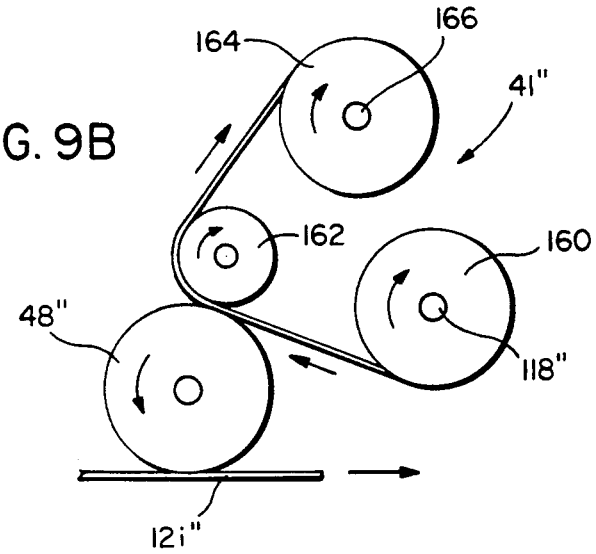

FIGS. 9A and 9B disclose alternate embodiments of primary feed roller cleaning mechanisms 41' and 41'', respectively. In FIG. 9A, a rotatable cleaning member 112' is provided with a layer of material 158 which will attract the contaminants on a primary feed roller 48', such as a piece of cellophane tape wrapped around the cleaning member. In FIG. 9B, the cleaning mechanism 41'' comprises a replaceable roll of material 160, such as cellophane tape, on a support shaft 118'', with the cellophane tape passing between a primary feed roller 48'' and an idler pinch roll 162 to a take up roll 164 on a support shaft 166.

Figure 10:
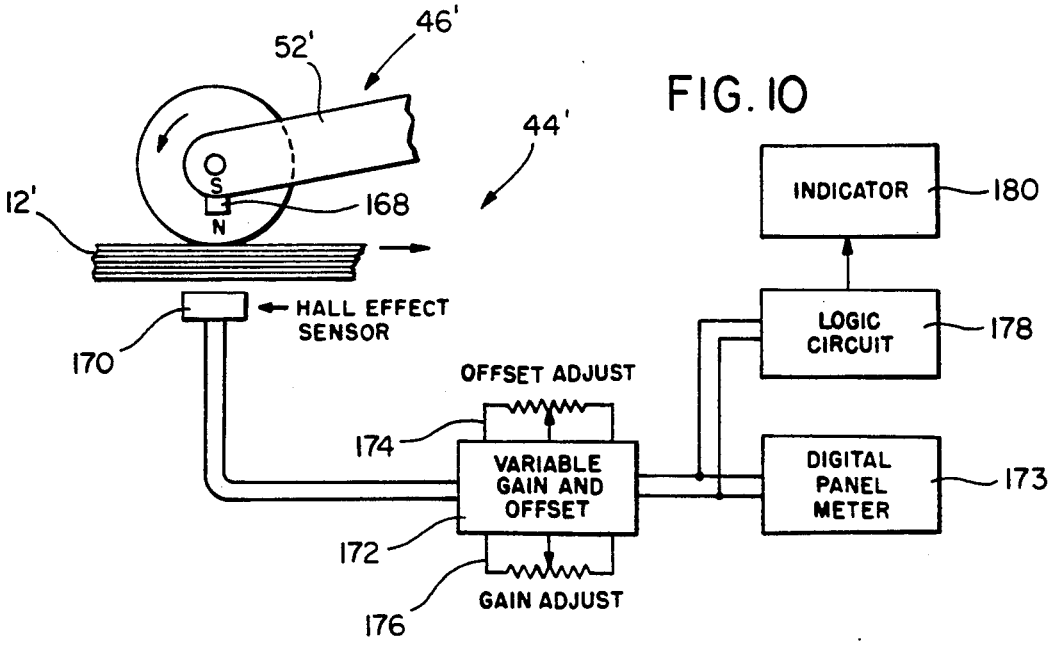

FIG. 10 discloses an alternate embodiment of a number-of-films-remaining system 44' which is in the form of one type of an electric device which may be utilized in accordance with the invention. In this embodiment of the invention, a small magnet 168 is mounted under a lever member 52' of a floating assembly 46', and a Hall effect sensor 170 which is responsive to magnetic flux, is fixedly mounted in a recess in an internal surface of a nonmagnetic magazine bottom and an opening in an associated leaf spring mechanism, neither of which are shown. Thus, as the Hall effect sensor 170 measures magnetic flux from the magnet 168 each time the floating assembly 46' moves vertically downward upon a feeding of one of a stack of films 12', a voltage signal proportional to the separation between the magnet 168 and the sensor 170 is fed to a variable gain-and-offset electronic circuit 172 of a known type which converts the voltage signal to a voltage which is proportional to the number of remaining films and which operates a digital panel meter 173, upon which the number of films remaining is then indicated. The variable gain-and-offset integrated circuit 172 also includes offset and gain adjust potentiometers 174 and 176, respectively, which can be used in an apparent manner to compensate for films 12' of different thicknesses. The latter voltage also may be fed to a suitable logic circuit 178 to give an operator an indication on an associated indicator display 180 as to whether a sufficient number of the films 12' remain to complete a particular diagnostic film exposure operation, and also may inhibit system operation (e.g., of an associated film exposure device) if insufficient films remain. Other electrical devices also may be used for indicating the number of the films 12 remaining, such as a linear displacement-type transformer, or reflective or transmissive-type photodetectors which use infrared light (so as to not damage the films 12).

In summary, with reference to FIGS. 1–5, a new and improved film sheet load magazine, such as the load magazine 10 for holding the films 12, has been disclosed. The load magazine 10, by means of the stop 32 on the top cover 28, and the leaf springs 122 and 124, enables the films 12 to be readily loaded into and then held in the magazine with their central portions in a curved configuration, and so that the film loading ends 12*b* are adjacent the separator mechanism 40, whereby the magazine is of compact, light-weight construction with a large film-holding capacity. The ease of film loading is enhanced by the floating drive assembly 46, comprising the primary feed rollers 48 and the roller cleaning brushes 112, in combination with the spring-biased lifting assemblies 76, which provide an arrangement by which the films 12 readily can be inserted beneath the feed rollers in the magazine loading operation. The cleaning brushes 112 are advantageous from the standpoint of cleaning contaminants from the primary feed rollers 48, to maintain their film-driving capability. In a film feeding operation, each of the films 12 can be initially fed at a relatively slow rate one at a time through the film separator mechanism 40 by the relatively slow-rotating primary feed rollers 48, and then accelerated and fed from the magazine 10 to the film exposure device 14 at a relatively high rate of speed by the faster-rotating secondary feed rollers 64. Driving of the internal mechanisms of the magazine 10 is readily accomplished by the gear rack 90 from the film exposure device 14. Further, the number-of-films-remaining indicating mechanism 44, which becomes automatically preset to indicate the number of films 12 in the magazine 10 upon closing of the top cover 28, eliminates the need for setting of a mechanism by an operator, with potential possibility for error, and the replaceable scales 128 provide an adjustment for compensating for films of different thicknesses. In addition, the embodiments of the invention shown in FIGS. 6–10 disclose additional advantageous features of the subject invention.

It is to be understood that various other modifications, additions and alternative designs are possible in light of the above teachings. Therefore, it also should be understood that within the scope of the appended claims, the invention may be practiced otherwise than specifically described hereinabove.

We claim:

1. A sheet feeding magazine, which comprises:

an enclosure adapted to receive a plurality of superimposed sheets, the enclosure including a wall having a sheet feed-out slot;

means in the enclosure for retaining at least central portions of the superimposed sheets in a curved essentially semi-circular configuration within the enclosure, with first end portions of the sheets adjacent the feed-out slot, and with a radius of curvature of the curved portions of the sheets and the length of an arc encompassed by the curved portions of the sheets being such that the sheets retain themselves in desired positions in the magazine independently of the orientation of the magazine with respect to gravity; and means in the enclosure for engaging and feeding an innermost one of the curved sheets, each subsequent innermost sheet and a last sheet from the enclosure through the feed-out slot.

2. The sheet feeding magazine as recited in claim 1, wherein the radius of curvature and the length of the arc are such that the frictional resistance between the innermost sheet and the next adjacent sheet is less than the frictional resistance between the other sheets independently of the orientation of the magazine with respect to gravity.

3. The sheet feeding magazine as recited in claim 1, wherein the sheet curving means includes a stop means for engaging opposite second end portions of the sheets.

4. The sheet feeding magazine as recited in claim 3, wherein the stop means is mounted on a cover member of the enclosure which is movable between open and closed positions.

5. The sheet feeding magazine as recited in claim 3 wherein:

separator means are provided in the enclosure adjacent the feed-out slot for preventing more than one sheet from feeding through the feed-out slot at a time; and the sheet curving means includes resilient means for biasing the first and second end portions of the sheets against the separator means and the stop means, respectively.

6. The sheet feeding magazine as recited in claim 5, wherein the resilient means includes a curved leaf spring mechanism.

7. The sheet feeding magazine as recited in claim 1, wherein the sheet feeding means includes power driven rollers for engaging and feeding the curved sheets.

8. The sheet feeding magazine as recited in claim 7, wherein the feeding of each of the superimposed sheets by the sheet feeding means is accomplished solely by the power driven rollers engaging only edge portions of the sheet.

9. The sheet feeding magazine as recited in claim 7, wherein the power driven feed rollers have roughened peripheral surfaces.

10. The sheet feeding mechanism as recited in claim 1, which further comprises:

separator means in the enclosure adjacent the feed-out slot for preventing more that one sheet from feeding through the feed-out slot at a time.

11. The sheet feeding magazine as recited in claim 1, wherein said sheet retaining means retains the sheets in the enclosure without any substantial reverse-bending of the sheets.

12. The sheet feeding magazine as recited in claim 1, which further comprises means in the enclosure for supporting and biasing the superimposed first end portions of the sheets to cause successive movement of the superimposed first end portions relative to the feed-out slot in response to the feeding of each innermost sheet through the feed-out slot, to bring the next innermost sheet into position for feeding through the feed-out slot.

13. The sheet feeding magazine as recited in claim 1, wherein said sheet feeding means includes feed roller means mounted so as to engage the first end portion of each successive innermost sheet while the first end portion of the sheet is superimposed on the other sheets, for feeding of the sheet through the feed-out slot.

14. The sheet feeding magazine as recited in claim 1, wherein the length of the arc encompassed by the curved portions of the sheets is at least 180 degrees.

15. A sheet feeding magazine, which comprises:

an enclosure adapted to receive a plurality of sheets which are in superimposed relationship, the enclosure including a wall having a sheet feed-out slot:

means in the enclosure for engaging and feeding each of the sheets from the enclosure through the feed-out slot;

means for opening and closing the enclosure; and means responsive to the opening-and-closing means for moving the sheet feeding means into and out of a sheet-feeding position.

16. The sheet feeding magazine as recited in claim 15, wherein the moving means is a slidably mounted spring-biased mechanism connected at one end to the sheet feeding means and engageable at an opposite end with the opening-and-closing means.

17. A sheet feeding magazine, which comprises:

an enclosure adapted to receive a plurality of sheets which are in superimposed relationship, the enclosure including a wall having a sheet feed-out slot;

means in the enclosure for engaging and feeding each of the sheets from the enclosure through the feed-out slot, the sheet feeding means including roller means for engaging and feeding the sheet; and means for cleaning the feed roller means as the feed roller means rotates.

18. The sheet feeding magazine as recited in claim 17, wherein the sheet feeding means further includes:

a rotatable drive shaft;

a floating rotatable shaft, the roller means being supported on the floating rotating shaft;

means for supporting the floating shaft for pivotable movement about the rotatable drive shaft; and means for driving the floating shaft and the roller means from the drive shaft.

19. The sheet feeding magazine as recited in claim 18, which further comprises:

a second floating shaft, the roller cleaning means being supported on the second floating shaft;

means for supporting the second floating shaft for pivotable movement on the drive shaft; and means for driving the second floating shaft from the drive shaft.

20. The sheet feeding magazine as recited in claim 19, wherein the first and second floating shafts are supported on the drive shaft by the same support means.

21. The sheet feeding magazine as recited in claim 17, wherein the feed roller cleaning means are rotatable members.

22. The sheet feeding magazine as recited in claim 21, wherein the feed roller cleaning means are brushes.

23. The sheet feeding magazine as recited in claim 22, wherein the feed roller means are rollers provided with peripheral grooves to facilitate the cleaning action of the brushes.

24. The sheet feeding magazine as recited in claim 17, wherein the feed roller cleaning means are members formed of a material which causes contaminants to adhere to the members.

25. The sheet feeding magazine as recited in claim 17, wherein the feed roller means includes means for engaging and penetrating a surface of each of the sheets.

26. The sheet feeding magazine as recited in claim 17, wherein the feed roller means are rollers having roughened peripheral surfaces.

27. A sheet feeding magazine, which comprises:

an enclosure adapted to receive a plurality of sheets which are in superimposed relationship, the enclosure including a wall having a sheet feed-out slot;

means in the enclosure for engaging and feeding each of the sheets from the enclosure through the feed-out slot; and means for indicating the number of sheets remaining in the enclosure as the sheets are fed by the sheet feeding means, the number-of-sheets-remaining indicating means being preset automatically to indicate the number of films in the enclosure in response to loading of the enclosure.

28. The sheet feeding magazine as recited in claim 27, wherein the number-of-sheets-remaining indicator means is adjustable for sheets of different thickness.

29. The sheet feeding mechanism as recited in claim 27, wherein the number-of-sheets-remaining indicating means includes a scale and a pointer.

30. The sheet feeding magazine as recited in claim 27, wherein the number-of-sheets-remaining indicating means is an electrical indicating means.

31. The sheet feeding magazine as recited in claim 30, wherein the number-of-sheets-remaining indicating means is responsive to movement of the sheet feeding means, and includes means for converting the movement of the sheet feeding means to an electrical signal.

32. The sheet feeding magazine as recited in claim 30, wherein the number-of-sheets-remaining indicating means further includes means for indicating when an insufficient number of sheets remain for a particular operation by an associated device upon which the magazine is mounted.

33. The sheet feeding magazine as recited in claim 30, wherein the number-of-sheet-remaining indicating means also inhibits operation of the associated device.

34. The sheet feeding magazine as recited in claim 30, wherein the number-of-sheets-remaining indicating means includes a magnet and a magnetic flux sensor.

35. A sheet feeding magazine, which comprises:

an enclosure adapted to receive a plurality of sheets which are in superimposed relationship, the enclosure including a wall having a sheet feed-out slot;

means in the enclosure for feeding each of the sheets from the enclosure through the feed-out slot, the sheet feeding means including primary feed rollers and secondary feed rollers, the primary rollers feeding the sheets to the secondary rollers and being driven slower than the secondary rollers, with the primary rollers being free to roll at the speed of the sheet when the sheet is being driven by the faster secondary rollers.

36. A sheet feeding magazine, which comprises:

an enclosure adapted to receive a plurality of sheets which are in superimposed relationship, the enclosure including a wall having a sheet feed-out slot;

means in the enclosure for engaging and feeding each of the sheets from the enclosure through the feed-out slot; and separator means in the enclosure for preventing more than one sheet from feeding through the feed-out slot at a time, the separator means comprising a roller and a screw-threaded rigid pin adjustably mounted opposite the roller to define a variable gap between the roller and the pin.

37. A sheet feeding magazine, which comprises:

an enclosure adapted to receive a plurality of sheets which are in superimposed relationship, the enclosure including a wall having a sheet feed-out slot;

means in the enclosure for engaging and feeding each of the sheets from the enclosure through the feed-out slot; and separator means in the enclosure adjacent the feed-out slot for preventing more than one sheet from feeding through the feed-out slot at a time, the separator means comprising first and second counter rotating rollers having a gap therebetween, the first rollers engaging the sheet to be fed and urging the sheet forward, and the second roller contacting other ones of the sheets which tend to breach the gap and urging these sheets backward, with the frictional force which the second roller exerts on the sheet to be fed being less than that exerted by the first roller.

38. A sheet feeding magazine, which comprises:

an enclosure adapted to receive a plurality of sheets which are in superimposed relationship, the enclosure including a wall having a sheet feed-out slot;

means in the enclosure for engaging and feeding each of the sheets from the enclosure through the feed-out slot;

movable separator means in the enclosure adjacent the feed-out slot for preventing more than one sheet from feeding through the feed-out slot at a time; and control means for controlling opening of said movable separator means so that feeding means feeds only one sheet at a time through the feed-out slot.

39. The sheet feeding magazine as recited in claim 38, wherein said control means opens the separator means to define a gap essentially corresponding to the thickness of a single sheet, and subsequently recloses the separator means, to permit said feeding means to cause the feeding of only one sheet at a time through the feed-out slot.

40. A sheet feeding magazine, which comprises:

an enclosure adapted to receive a stack of sheets which are in superimposed relationship, the enclosure including a wall having a sheet feed-out slot;

means in the enclosure for retaining at least central portions of the superimposed sheets in a curved essentially semi-circular configuration within the enclosure, with adjacent portions at one end of the sheets adjacent the feed-out slot, and with a radius of curvature of the curved portions and the length of an arc encompassed by the curved portions of the sheets being such that the sheets retain themselves in desired positions in the magazine independent of gravity, and such that an innermost sheet and each subsequent innermost sheet tend to be ejected from the stack so as to be self-feeding; and means for controlling the feeding of the sheets from the magazine one at a time.

41. The sheet feeding magazine as recited in claim 40, wherein the length of the arc encompassed by the curved portions of the sheets is less than 180 degrees.

42. A sheet feeding magazine, which comprises:

an enclosure including a wall having a sheet feed-out slot, the enclosure being adapted to receive a plurality of sheets which are in superimposed relationship with leading end portions of the sheets in touching engagement adjacent the feed-out slot;

means in the enclosure for causing each of the sheets to feed from the enclosure through the feed-out slot; and separator means in the enclosure adjacent the feed-out for preventing more than one sheet from feeding through the feed-out slot at a time, the separator means including opposed members for defining a gap through which the sheets feed one at a time to the feed-out slot.

43. A sheet feeding magazine, which comprises:

an enclosure adapted to receive a plurality of superimposed sheets, the enclosure including a wall having a sheet feed-out slot;

means in the enclosure for retaining at least central portions of the superimposed sheets in a curved essentially semi-circular configuration within the enclosure, with first end portions of the sheets adjacent the feed-out slot, and with a radius of curvature of the curved portions of the sheets and the length of an arc encompassed by the curved portions of the sheets being such that the sheets retain themselves in desired positions in the magazine independently of the orientation of the magazine with respect to gravity;

means in the enclosure for engaging and feeding an innermost one of the curved sheets, each subsequent innermost sheet and a last sheet from the enclosure through the feed-out slot;

means for opening and closing the enclosure; and means responsive to the opening-and-closing means for moving the sheet feeding means into and out of a sheet-feeding position.

44. A sheet feeding magazine, which comprises:

an enclosure adapted to receive a plurality of superimposed sheets, the enclosure including a wall having a sheet feed-out slot;

means in the enclosure for retaining at least central portions of the superimposed sheets in a curved essentially semi-circular configuration within the enclosure, with first end portions of the sheets adjacent the feed-out slot, and with a radius of curvature of the curved portions of the sheets and the length of an arc encompassed by the curved portions of the sheets being such that the sheets retain themselves in desired positions in the magazines independently of the orientation of the magazine with respect to gravity;

means in the enclosure for engaging and feeding an innermost one of the curved sheets, each subsequent innermost sheet and a last sheet from the enclosure through the feed-out slot, the sheet feeding means including roller means for engaging and feeding the curved sheets; and means for cleaning the feed roller means as the feed roller means rotates.

45. The sheet feeding magazine as recited in claim 44, wherein the feed roller cleaning means are rotatable members.

46. The sheet feeding magazine as recited in claim 45, wherein the feed roller cleaning means are brushes.

47. The sheet feeding magazine as recited in claim 46, wherein the feed roller means are rollers provided with peripheral grooves to facilitate the cleaning action of the brushes.

48. The sheet feeding magazine as recited in claim 44, wherein the feed roller cleaning means are members formed of a material which causes contaminants to adhere to the members.

49. A sheet feeding magazine, which comprises:

an enclosure adapted to receive a plurality of superimposed sheets, the enclosure including a wall having a sheet feed-out slot;

means in the enclosure for retaining at least central portions of the superimposed sheets in a curved essentially semi-circular configuration within the enclosure, with first end portions of the sheets adjacent the feed-out slot, and with a radius of curvature of the curved portions of the sheets and the length of an arc encompassed by the curved portions of the sheets being such that the sheets retain themselves in desired positions in the magazine independently of the orientation of the magazine with respect to gravity;

means in the enclosure for engaging and feeding an innermost one of the curved sheets, each subsequent innermost sheet and a last sheet from the enclosure through the feed-out slot, the sheet feeding means including roller means for engaging and feeding the curved sheets;

a rotatable drive shaft;

a floating rotatable shaft, the roller means being supported on the floating rotatable shaft;

means for supporting the floating rotatable shaft for pivotable movement about the rotatable drive shaft; and means for driving the floating rotatable shaft and the roller means from the rotatable drive shaft.

50. The sheet feeding magazine as recited in claim 49, which further comprises:

means for engaging and cleaning the feed roller means as the feed roller means rotates:

a second floating shaft, the roller cleaning means being supported on the second floating shaft;

means for supporting the second floating shaft for pivotable movement on the drive shaft; and means for driving the second floating shaft from the drive shaft.

51. The sheet feeding magazine as recited in claim 50, wherein the first and second floating shafts are supported on the drive shaft by the same support means.

52. A sheet feeding magazine, which comprises:

an enclosure adapted to receive a plurality of superimposed sheets, the enclosure including a wall having a sheet feed-out slot;

means in the enclosure for retaining at least central portions of the superimposed sheets in a curved essentially semi-circular configuration within the enclosure, with first end portions of the sheets adjacent the feed-out slot, and with a radius of curvature of the curved portions of the sheets and the length of an arc encompassed by the curved portions of the sheets being such that the sheets retain themselves in desired positions in the magazine independently of the orientation of the magazine with respect to gravity;

means in the enclosure for engaging and feeding an innermost one of the curved sheets, each subsequent innermost sheet and a last sheet from the enclosure through the feed-out slot, the sheet feeding means including roller means for engaging and feeding the curved sheets;

means for opening and closing the enclosure; and spring-biased means responsive to the opening-and-closing means for moving the feed roller means into and out of a sheet-feeding position.

53. A sheet feeding magazine, which comprises:

an enclosure adapted to receive a plurality of superimposed sheets, the enclosure including a wall having a sheet feed-out slot;

means in the enclosure for retaining at least central portions of the superimposed sheets in a curved essentially semi-circular configuration within the enclosure, with first end portions of the sheets adjacent the feed-out slot, and with a radius of curvature of the curved portions of the sheets and the length of an arc encompassed by the curved portions of the sheets being such that the sheets retain themselves in desired positions in the magazine independently of the orientation of the magazine with respect to gravity;

means in the enclosure for engaging and feeding an innermost one of the curved sheets, each subsequent innermost sheet and a last sheet from the enclosure through the feed-out slot, the sheet feeding means including roller means for engaging and feeding the curved sheets; and gear rack means for driving the feed roller means.

54. The sheet feeding magazine as recited in claim 53, wherein the gear rack means is driven by a rod from an associated device upon which the sheet feeding magazine is mounted.

55. A sheet feeding magazine, which comprises:

an enclosure adapted to receive a plurality of superimposed sheets, the enclosure including a wall having a sheet feed-out slot;

means in the enclosure for retaining at least central portions of the superimposed sheets in a curved essentially semi-circular configuration within the enclosure, with first end portions of the sheets adjacent the feed-out slot, and with a radius of curvature of the curved portions of the sheets and the length of an arc encompassed by the curved portions of the sheets being such that the sheets retain themselves in desired positions in the magazine independently of the orientation of the magazine with respect to gravity; and means in the enclosure for engaging and feeding an innermost one of the curved sheets, each subsequent innermost sheet and a last sheet from the enclosure through the feed-out slot, the sheet feeding means including roller means for engaging and feeding the curved sheets and the roller means including means for engaging and penetrating a surface of each of the sheets.

56. A sheet feeding magazine, which comprises:

an enclosure adapted to receive a plurality of superimposed sheets, the enclosure including a wall having a sheet feed-out slot;

means in the enclosure for retaining at least central portions of the superimposed sheets in a curved essentially semi-circular configuration within the enclosure, with first end portions of the sheets adjacent the feed-out slot, and with a radius of curvature of the curved portions of the sheets and the length of an arc encompassed by the curved portions of the sheets being such that the sheets retain themselves in desired positions in the magazine independently of the orientation of the magazine with respect to gravity;

means in the enclosure for engaging and feeding an innermost one of the curved sheets, each subsequent innermost sheet and a last sheet from the enclosure through the feed-out slot, the sheet feeding means including roller means for engaging and feeding the curved sheets; and means for indicating the number of sheets remaining in the enclosure as the sheets are fed from the enclosure by the sheet feeding means.

57. The sheet feeding magazine as recited in claim 56, wherein the feed roller means is pivotably mounted and the number-of-sheets-remaining indicating means is responsive to the degree of pivotable movement of the feed roller means.

58. The sheet feeding magazine as recited in claim 57, wherein the number-of-sheets-remaining indicating means includes a scale and a pointer.

59. The sheet feeding magazine as recited in claim 57, wherein the number-of-sheets-remaining means includes a magnet and a magnetic flux sensor.

60. A sheet feeding magazine, which comprises:

an enclosure adapted to receive a plurality of superimposed sheets, the enclosure including a wall having a sheet feed-out slot;

means in the enclosure for retaining at least central portions of the superimposed sheets in a curved essentially semi-circular configuration within the enclosure, with first end portions of the sheets adjacent the feed-out slot, and with a radius of curvature of the curved portions of the sheets and the length of an arc encompassed by the curved portions of the sheets being such that the sheets retain themselves in desired positions in the magazine independently of the orientation of the magazine with respect to gravity; and means in the enclosure for engaging and feeding an innermost one of the curved sheets, each subsequent innermost sheet and a last sheet from the enclosure through the feed-out slot, the sheet feeding means including primary feed rollers and secondary feed rollers, the primary rollers feeding the sheets to the secondary rollers and being driven slower than the secondary rollers, with the primary rollers being free to roll at the speed of the sheet when the sheet is driven by the faster secondary rollers.

61. A sheet feeding magazine, which comprises:

an enclosure adapted to receive a plurality of superimposed sheets, the enclosure including a wall having a sheet feed-out slot;

means in the enclosure for retaining at least central portions of the superimposed sheets in a curved essentially semi-circular configuration within the enclosure, with first end portions of the sheets adjacent the feed-out slot, and with a radius of curvature of the curved portions of the sheet and the length of an arc encompassed by the curved portions of the sheets being such that the sheets retain themselves in desired positions in the magazine independently of the orientation of the magazine with respect to gravity; and means in the enclosure for engaging and feeding an innermost one of the curved sheets, each subsequent innermost sheet and a last sheet from the enclosure through the feed-out slot, the sheet feeding means including a feed roller means and at least one one-way clutch for operating the feed roller means, and further including means for operating the one-way clutch independently of an associated device upon which the magazine is mounted.

62. A sheet feeding magazine, which comprises:

an enclosure adapted to receive a plurality of superimposed sheets, the enclosure including a wall having a sheet feed-out slot;

means in the enclosure for retaining at least central portions of the superimposed sheets in a curved essentially semi-circular configuration within the enclosure, with first end portions of the sheets adjacent the feed-out slot, and with a radius of curvature of the curved portions of the sheets and the length of an arc encompassed by the curved portions of the sheets being such that the sheets retain themselves in desired positions in the magazine independently of the orientation of the magazine with respect to gravity;

means in the enclosure for engaging and feeding an innermost one of the curved sheets, each subsequent innermost sheet and a last sheet from the enclosure through the feed-out slot;

means for moving the sheet feeding means into and out of a sheet-engaging feeding position for the feeding of each sheet; and means for continuously driving the sheet feeding means.

63. A sheet feeding magazine, which comprises:

an enclosure adapted to receive a plurality of superimposed sheets, the enclosure including a wall having a sheet feed-out slot;

means in the enclosure for retaining at least central portions of the superimposed sheets in a curved essentially semi-circular configuration within the enclosure, with first end portions of the sheets adjacent the feed-out slot, and with a radius of curvature of the curved portions of the sheets and the length of an arc encompassed by the curved portions of the sheets being such that the sheets retain themselves in desired positions in the magazine independently of the orientation of the magazine with respect to gravity;

means in the enclosure for engaging and feeding an innermost one of the curved sheets, each subsequent innermost sheet and a last sheet from the enclosure through the feed-out slot; and sheet separator means including a roller and a screw-threaded rigid pin adjustably mounted opposite the roller to define a variable gap between the roller and the pin.

64. A sheet feeding magazine, which comprises:

an enclosure adapted to receive a plurality of superimposed sheets, the enclosure including a wall having a sheet feed-out slot;

means in the enclosure for retaining at least central portions of the superimposed sheets in a curved essentially semi-circular configuration within the enclosure, with first end portions of the sheets adjacent the feed-out slot, and with a radius of curvature of the curved portions of the sheets and the length of an arc encompassed by the curved portions of the sheets being such that the sheets retain themselves in desired positions in the magazine independently of the orientation of the magazine with respect to gravity;

means in the enclosure for engaging and feeding an innermost one of the curved sheets, each subsequent innermost sheet and a last sheet from the enclosure through the feed-out slot; and sheet separator means including first and second counter rotating rollers having a gap therebetween, the first rollers engaging the sheet to be fed and urging the sheet forward, and the second roller contacting other ones of the sheets which tend to breach the gap and urging these sheets backward, with the frictional force which the second roller exerts on the sheet to be fed being less than that exerted by the first roller.

65. A sheet feeding magazine, which comprises:

an enclosure adapted to receive a plurality of superimposed sheets, the enclosure including a wall having a sheet feed-out slot;

means in the enclosure for retaining at least central portions of the superimposed sheets in a curved essentially semi-circular configuration within the enclosure, with first end portions of the sheets adjacent the feed-out slot, and with a radius of curvature of the curved portions of the sheets and the length of an arc encompassed by the curved portions of the sheets being such that the sheets retain themselves in desired positions in the magazine independently of the orientation of the magazine with respect to gravity;

means in the enclosure for engaging and feeding an innermost one of the curved sheets, each subsequent innermost sheet and a last sheet from the enclosure through the feed-out slot; and separator means adjacent the feed-out slot for preventing more than one sheet from feeding through the feed-out slot at a time, the separator means being controllably opened to feed one sheet at a time.

66. A sheet feeding magazine, which comprises:

an enclosure adapted to receive a plurality of superimposed sheets, the enclosure including a wall having a sheet feed-out slot;

means in the enclosure for retaining at least central portions of the superimposed sheets in a curved essentially semi-circular configuration within the enclosure, with first end portions of the sheets adjacent the feed-out slot, and with a radius of curvature of the curved portions of the sheets and the length of an arc encompassed by the curved portions of the sheets being such that the sheets retain themselves in desired positions in the magazine independently of the orientation of the magazine with respect to gravity;

means in the enclosure for engaging and feeding an innermost one of the curved sheets, each subsequent innermost sheet and a last sheet from the enclosure through the feed-out slot; and means for indicating the number of sheets remaining in the enclosure as the sheets are fed from the enclosure by the sheet feeding means.

67. The sheet feeding magazine as recited in claim 66, wherein the number-of-sheets-remaining indicating means is preset automatically to indicate the number of films in the enclosure in response to loading of the enclosure.

68. The sheet feeding magazine as recited in claim 66, wherein the number-of-sheets-remaining indicator means is adjustable for sheets of different thickness.

69. The sheet feeding mechanism as recited in claim 66, wherein the number-of-sheets-remaining indicating means includes a scale and a pointer.

70. The sheet feeding magazine as recited in claim 66, wherein the number-of-sheets-remaining indicating means is an electrical indicating means.

71. The sheet feeding magazine as recited in claim 70, wherein the number-of-sheets-remaining indicating means is responsive to movement of the sheet feeding means, and includes means for converting the movement of the sheet feeding means to an electrical signal.

72. The sheet feeding magazine as recited in claim 70, wherein the number-of-sheets-remaining indicating means further includes means for indicating when an insufficient number of sheets remain for a particular operation by an associated device upon which the magazine is mounted.

73. The sheet feeding magazine as recited in claim 72, wherein the number-of-sheets-remaining indicator means also inhibits operation of the associated device.

74. The sheet feeding magazine as recited in claim 70, wherein the number-of-sheets-remaining indicating means includes a magnet and a magnetic flux sensor.

75. A sheet feeding magazine, which comprises:

an enclosure adapted to receive a stack of sheets which are in superimposed relationship, the enclosure including a wall having a sheet feed-out slot;

means in the enclosure for retaining at least central portions of the superimposed sheets in a curved essentially semi-circular configuration within the enclosure, with adjacent portions at one end of the sheets adjacent the feed-out slot, and with a radius of curvature of the curved portions and the length of an arc encompassed by the curved portions of the sheets being such that the sheets retain themselves in desired positions in the magazine independent of gravity, and such that an innermost sheet and each subsequent innermost sheet is self-feeding so as to be ejected from the stack without any supplemental feed mechanism; and means for controlling the feeding of the sheets from the magazine one at a time.

* * * * *